US012150521B2

(12) United States Patent
Suzuki et al.

(10) Patent No.: US 12,150,521 B2
(45) Date of Patent: Nov. 26, 2024

(54) UPPER AND SHOE

(71) Applicant: ASICS CORPORATION, Kobe (JP)

(72) Inventors: Chihaya Suzuki, Hyogo (JP); Seiji Yano, Hyogo (JP); Katsunori Yagyu, Hyogo (JP); Yoshiyasu Ando, Hyogo (JP); Keita Ozawa, Hyogo (JP); Yousuke Atarashi, Hyogo (JP); Shingo Masumoto, Hyogo (JP); Hiroaki Nishimura, Hyogo (JP); Kenta Tateno, Hyogo (JP)

(73) Assignee: ASICS CORPORATION, Kobe (JP)

( * ) Notice: Subject to any disclaimer, the term of this patent is extended or adjusted under 35 U.S.C. 154(b) by 159 days.

(21) Appl. No.: 17/822,414

(22) Filed: Aug. 25, 2022

(65) Prior Publication Data

US 2023/0075713 A1 Mar. 9, 2023

(30) Foreign Application Priority Data

Sep. 6, 2021 (JP) ..... 2021-144445

(51) Int. Cl.
*A43B 23/02* (2006.01)

(52) U.S. Cl.
CPC ..... *A43B 23/0245* (2013.01); *A43B 23/0205* (2013.01); *A43B 23/027* (2013.01)

(58) Field of Classification Search
CPC ..... A43B 23/0205; A43B 23/0245; A43B 23/027; A43B 23/0265; A43B 23/028
USPC ..... 36/45
See application file for complete search history.

(56) References Cited

U.S. PATENT DOCUMENTS

2005/0193592 A1* 9/2005 Dua ..... A43B 7/14 36/45
2011/0041359 A1* 2/2011 Dojan ..... A43C 1/00 36/47
2014/0310984 A1 10/2014 Tamm et al.
2014/0338222 A1* 11/2014 Song ..... A43B 23/042 12/146 C
2014/0373389 A1* 12/2014 Bruce ..... A43B 23/04 36/83

(Continued)

FOREIGN PATENT DOCUMENTS

EP 2 792 264 A2 10/2014
EP 2 949 457 A1 12/2015
JP 5442170 B1 3/2014

OTHER PUBLICATIONS

The extended European search report issued by the European Patent Office on Jan. 3, 2023, which corresponds to European Application No. 22194177.6-1015 and is related to U.S. Appl. No. 17/822,414.

*Primary Examiner* — Marie D Bays
(74) *Attorney, Agent, or Firm* — Studebaker & Brackett PC

(57) ABSTRACT

An upper includes an upper main body that covers an instep of a foot. A first region and a second region adjacent to the first region are formed in the upper main body. The upper main body includes: a first linear body provided across the first region and the second region or provided only in the second region; and a second linear body provided in the first region while avoiding the second region and having an end located at a boundary portion between the first region and the second region. The first linear body and the second linear body have mutually different stretchability.

20 Claims, 14 Drawing Sheets

(56) References Cited

U.S. PATENT DOCUMENTS

| | | | | |
|---|---|---|---|---|
| 2015/0075031 | A1* | 3/2015 | Podhajny | D04B 1/16 66/196 |
| 2015/0143716 | A1* | 5/2015 | Long | A43B 23/0235 36/83 |
| 2015/0216258 | A1 | 8/2015 | Ueda et al. | |
| 2016/0058098 | A1* | 3/2016 | Cross | A43B 13/14 24/712 |
| 2016/0345675 | A1* | 12/2016 | Bruce | A43B 23/042 |
| 2019/0098955 | A1* | 4/2019 | Bruce | A43B 23/024 |
| 2020/0375316 | A1 | 12/2020 | Dealey et al. | |
| 2020/0405003 | A1* | 12/2020 | Poegl | A43B 23/024 |
| 2023/0075713 | A1* | 3/2023 | Suzuki | A43B 23/042 |

* cited by examiner

UPPER AND SHOE

CROSS-REFERENCE TO RELATED APPLICATIONS

The present application claims priority to and incorporates by reference the entire contents of Japanese Patent Application No. 2021-144445 filed in Japan on Sep. 6, 2021.

BACKGROUND OF THE INVENTION

1. Field of the Invention

The present invention relates to an upper and a shoe including the upper.

2. Description of the Related Art

Conventionally, shoe including an upper is known. During a motion of a wearer of the shoe, bending, contraction, twisting, and the like partially occur in a foot. Therefore, a technique of partially changing stretchability of the upper has been developed in order to enhance followability of the upper to the bending, contraction, twisting, and the like of the foot at the time of the motion.

For example, JP 5442170 B2 discloses an upper in which a plurality of reinforcing materials formed by a resin is fixed to a base material formed by a knitted fabric or a woven fabric. In the upper disclosed in JP 5442170 B2, stretchability of the upper can be partially changed by using a plurality of reinforcing materials having different stretchability.

Unfortunately, as in JP 5442170 B2, when a plurality of reinforcing materials formed by a resin is fixed to a base material formed by a knitted fabric or a woven fabric, or a plurality of reinforcing materials having different stretchability are used, the number of types of materials used for the upper increases. Therefore, in the upper disclosed in JP 5442170 B2, there is a problem that the number of processes of manufacturing, cutting, and sewing of materials increases, and an amount of waste materials and an amount of electricity consumed increase, leading to a decrease in productivity and an increase in environmental load and the like.

SUMMARY OF THE INVENTION

In order to solve the above problem and achieve the object, an upper according to this invention includes: an upper main body configured to cover an instep of a foot. A first region and a second region adjacent to the first region are formed in the upper main body, the upper main body includes: a first linear body provided across the first region and the second region or provided only in the second region; and a second linear body provided in the first region while avoiding the second region and having an end located at a boundary portion between the first region and the second region, and the first linear body and the second linear body have mutually different stretchability.

DETAILED DESCRIPTION OF THE PREFERRED EMBODIMENTS

Figure 1:
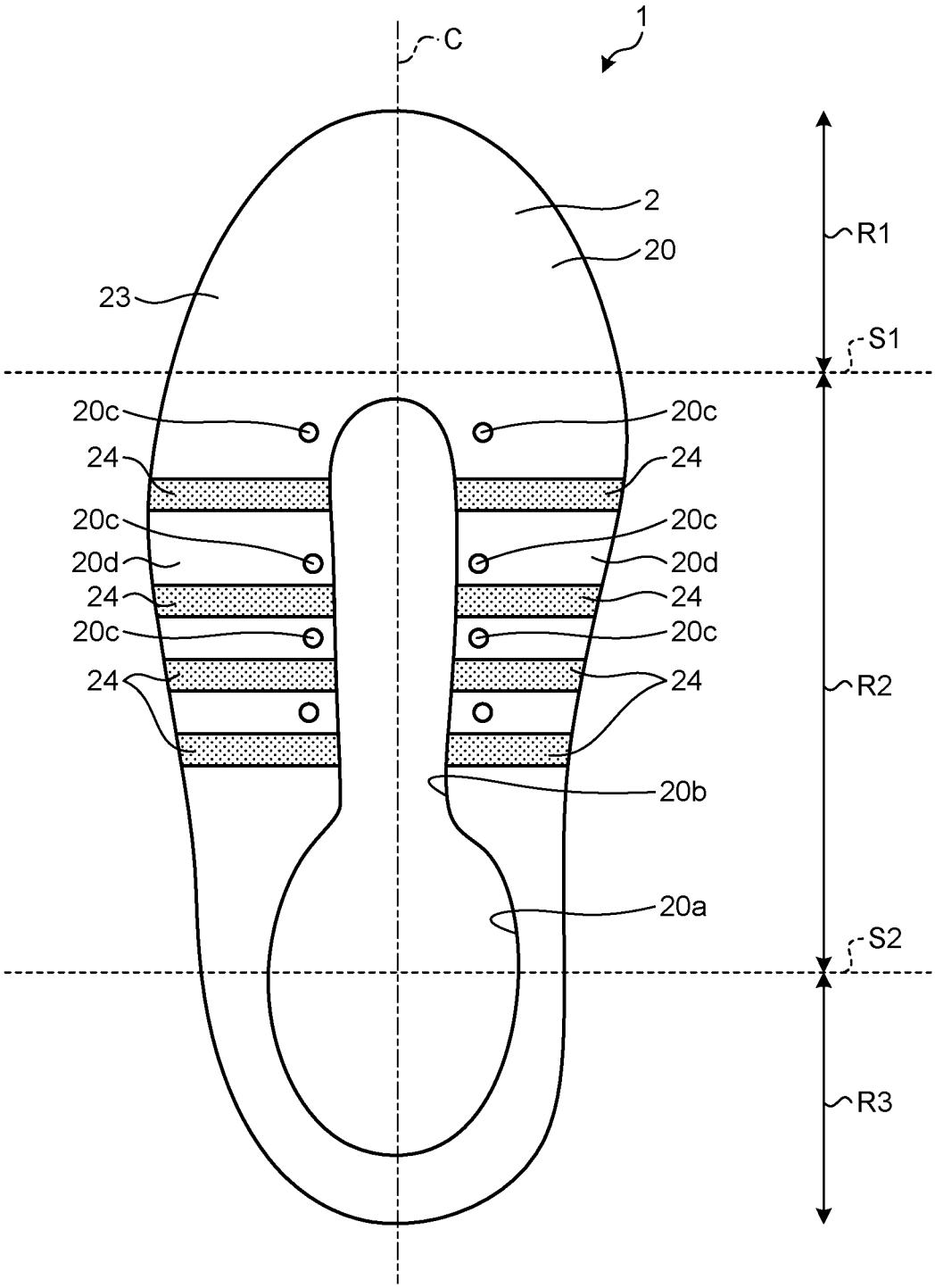
FIG. 1 is a plan view illustrating a shoe according to a first embodiment of the present invention.

Hereinafter, examples of an upper and a shoe according to the present invention will be described in detail with reference to the drawings. Note that the present invention is not limited by the examples. In the following description, identical portions are denoted by the same reference numerals, and redundant descriptions will be omitted.

First Embodiment

FIG. 1 is a plan view illustrating a shoe 1 according to a first embodiment of the present invention. In the individual figures including FIG. 1, the shoe 1 for a left foot alone is illustrated. Since the shoe 1 has a laterally symmetrical structure for a left foot and a right foot, the shoe 1 for the left foot alone will be described in the present embodiment, and a description of the shoe 1 for the right foot will be omitted. Further, in the following description, an extending direction of a shoe center axis C, which is a perpendicular line passing through a center of the shoe 1 in plan view of the shoe 1, is referred to as a fore-rear direction, and a direction orthogonal to the fore-rear direction in plan view of the shoe 1 is referred to as a foot width direction.

Further, a direction in the fore-rear direction from a terminal end on a side where a portion that supports a hindfoot portion of the foot is located in the shoe 1 toward a terminal end on a side where a portion that supports a forefoot portion of the foot is located in the shoe 1 is referred to as forward, and a direction in the fore-rear direction from the terminal end on the side where the portion that supports the forefoot portion of the foot is located in the shoe 1 toward the terminal end on the side where the portion that supports the hindfoot portion of the foot is located in the shoe 1 is referred to as rearward.

In addition, a median side of a foot in the anatomical position is referred to as a medial foot side, and a side opposite to the median side of the foot in the anatomical position is referred to as a lateral foot side. That is, a side closer to the median line in the anatomical position is referred to as the medial foot side, and a side farther from the median line in the anatomical position is referred to as the lateral foot side.

In addition, an up-down direction means a direction orthogonal to both the fore-rear direction and the foot width direction unless otherwise specified.

An upper 2 includes: an upper forefoot portion R1 that covers a forefoot portion of a foot of a wearer of a standard body shape; an upper midfoot portion R2 that covers a midfoot portion of a foot of a wearer having a standard body shape; and an upper rearfoot portion R3 that covers a hindfoot portion of a foot of a wearer having a standard body shape. The upper forefoot portion R1, the upper midfoot portion R2, and the upper rearfoot portion R3 are connected in this order in the fore-rear direction from forward of the upper 2.

A line being along the foot width direction and passing a position corresponding to approximately 25% of a dimension from a front end of the upper 2 in the fore-rear direction of the upper 2 is defined as a first boundary line S1, and a line being along the foot width direction and passing a position corresponding to approximately 80% of a dimension from the front end of the upper 2 in the fore-rear direction of the upper 2 is defined as a second boundary line S2. The first boundary line S1 is a line substantially along an MP joint of a wearer having a standard body shape. The second boundary line S2 is a line substantially along the Chopart's joint of a wearer having a standard body shape. The upper forefoot portion R1 is a portion located forward of the first boundary line S1. The upper midfoot portion R2 is a portion located between the first boundary line S1 and the second boundary line S2. The upper rearfoot portion R3 is a portion located rearward of the second boundary line S2.

Figure 2:
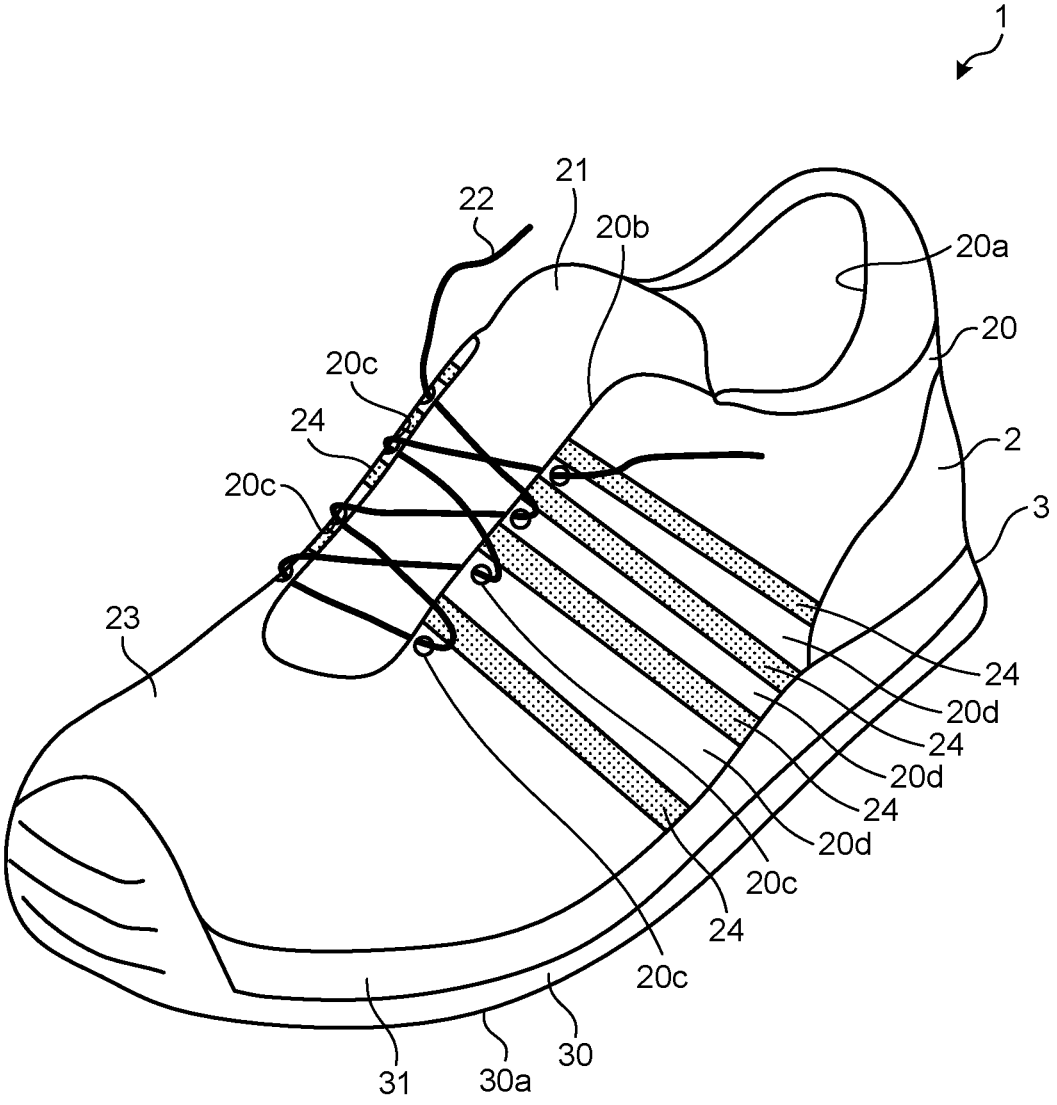
FIG. 2 is a perspective view illustrating the shoe according to the first embodiment.

FIG. 2 is a perspective view illustrating the shoe 1 according to the first embodiment. The shoe 1 is, for example, running shoe, other sports shoe, walking shoe, and climbing shoe. The shoe 1 includes the upper 2 and a sole 3.

The upper 2 is located above the sole 3. The upper 2 includes an upper main body 20, a shoe tongue 21, and a shoelace 22.

The upper main body 20 covers a portion on an instep side of a foot. In an upper portion of the upper main body 20, a foot insertion opening 20*a* for insertion of a foot of a wearer, and a throat portion 20*b* communicating with the foot insertion opening 20*a* and extending forward from the foot insertion opening 20*a* are formed. On side edges of the throat portion 20*b* on both sides in the foot width direction, string passing portions 20*c* spaced apart from each other in the fore-rear direction are provided. A configuration of the string passing portion 20*c* is not particularly limited as long as the shoelace 22 can pass through, but the string passing portion 20*c* is a through hole penetrating the upper main body 20 in the up-down direction, in the present embodiment. In the upper main body 20, a first region 23 and a second region 24 adjacent to the first region 23 are formed. Details of the first region 23 and the second region 24 will be described later. In the individual figures including FIG. 2, the second region 24 is illustrated by dot hatching in order to distinguish between the first region 23 and the second region 24.

The shoe tongue 21 is a member for protection of the instep of the foot of the wearer. The shoe tongue 21 covers the throat portion 20*b* inside the upper main body 20. The shoe tongue 21 is fixed to the upper main body 20 by stitching, welding, bonding, or a combination thereof. The material of the upper main body 20 and the shoe tongue 21 is woven fabric or knitted fabric. In particular, in the shoe 1 required to have air permeability and lightweight property, the material of the upper main body 20 and the shoe tongue 21 is preferably a double raschel warp knitted fabric knitted with polyester yarn. Note that the material of the shoe tongue 21 is not limited to the exemplified material.

The shoelace 22 is a string-shaped member that is alternately passed through the string passing portion 20*c* provided at one side edge in the foot width direction of the throat portion 20*b* and the string passing portion 20*c* provided at another side edge in the foot width direction of the throat portion 20*b*. The shoelace 22 is detachably attached to the upper main body 20.

In the present embodiment, the upper 2 including the shoe tongue 21 and the shoelace 22 will be described as an example, but the upper 2 may have a monosock structure in which a portion corresponding to the shoe tongue 21 is integrated with an ankle portion of the upper main body 20. In addition, a hook-and-loop fastener may be used instead of the shoelace 22 to bring the upper main body 20 into close contact with the foot. When the hook-and-loop fastener is used to bring the upper main body 20 into close contact with the foot, the string passing portion 20*c* is not formed in the upper main body 20.

The sole 3 is located below the upper 2. The sole 3 covers the sole of a wearer. The sole 3 includes an outsole 30 and a midsole 31. The sole 3 is fixed to the upper main body 20 by stitching, welding, bonding, or a combination thereof. A lower surface of the outsole 30 serves as a ground contact surface 30*a* to be in contact with the ground. The midsole 31 is located on an upper surface of the outsole 30, and has a cushioning property. Alternatively, the outsole 30 may be integrated with the midsole 31. The outsole 30 integrated with the midsole 31 is also referred to as a "unisole".

The sole 3 includes an insole (not illustrated) that covers a lower opening of the upper main body 20. The insole is fixed to a lower edge of the upper main body 20 by stitching. Further, the insole is fixed to an upper surface of the midsole 31 by bonding or welding. The shoe 1 may also include a footbed. When the shoe 1 includes a footbed, the footbed is placed on the sole 3 inside the upper 2. Alternatively, the sole 3 may have a structure in which the insole is omitted.

Figure 3:
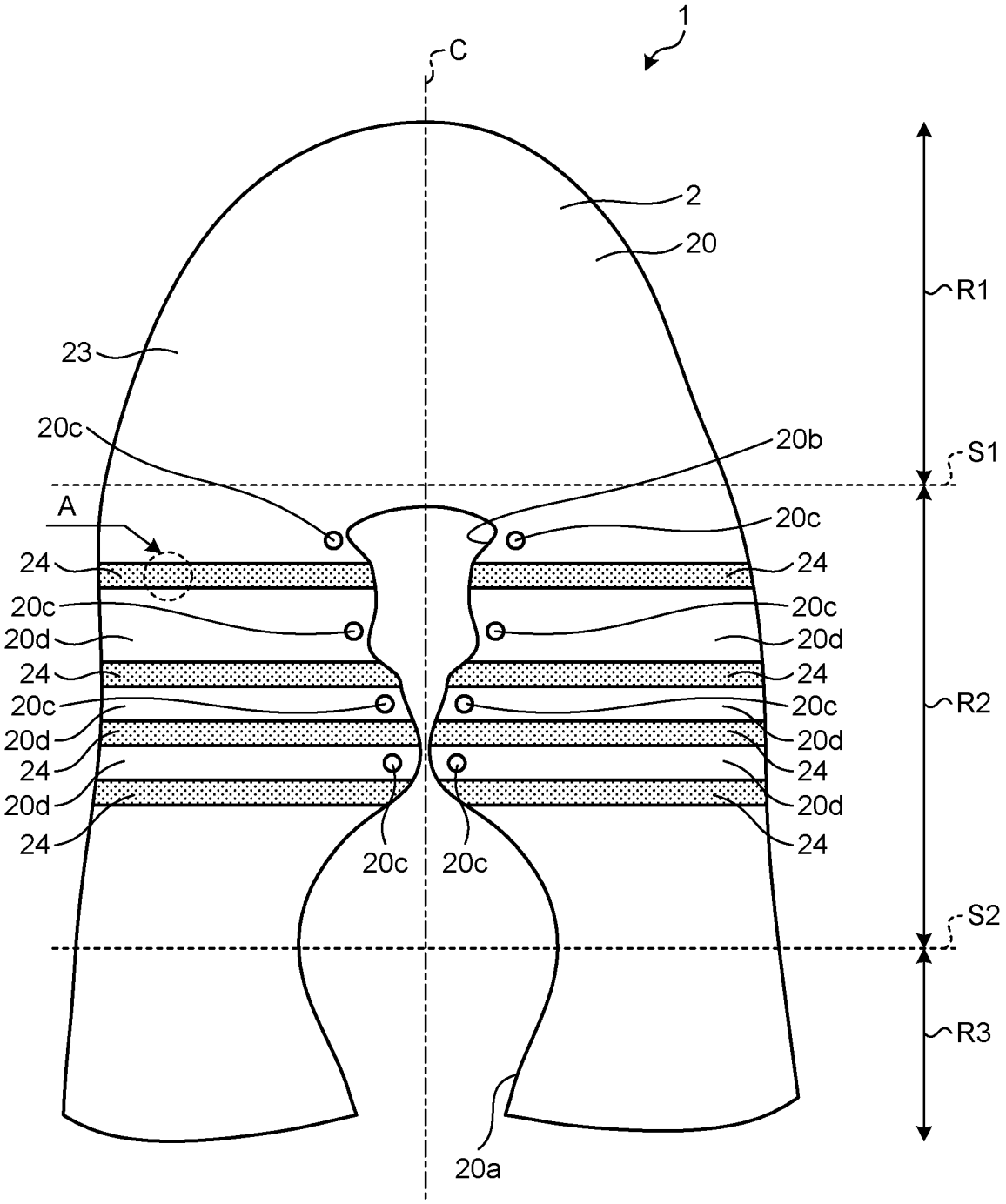
FIG. 3 is a developed view illustrating an upper main body according to the first embodiment.

Next, with reference to FIG. 3, a configuration of the upper main body 20 will be described in more detail. FIG. 3 is a developed view illustrating the upper main body 20 according to the first embodiment. As illustrated in FIG. 3, the first region 23 and the second region 24 are formed in the upper main body 20. The first region 23 is a region other than the second region 24, the foot insertion opening 20*a*, and the throat portion 20*b* in the upper main body 20. It suffices that the second region 24 is formed in at least one of the upper forefoot portion R1, the upper midfoot portion R2, or the upper rearfoot portion R3, but the second region 24 is formed only in the upper midfoot portion R2 in the present embodiment.

The number of the second regions 24 is not particularly limited. However, in the present embodiment, four second regions 24 are provided on each of both sides in the foot width direction across the throat portion 20*b*. The four second regions 24 are provided at intervals in the fore-rear direction. Each of the second regions 24 extends in the foot width direction of the upper main body 20 in the upper midfoot portion R2. Each second region 24 extends from an edge of the throat portion 20*b* to a lower edge of the upper main body 20. A plan view shape of each second regions 24 is not particularly limited, but is a band shape longer in the foot width direction than in the fore-rear direction, in the present embodiment. Between the second regions 24 adjacent in the fore-rear direction, one string passing portion 20*c* is arranged. Furthermore, one string passing portion 20*c* is also arranged in forward of the second region 24 located at the foremost position. In the following description, a portion of the first region 23 between the adjacent second regions 24 where the string passing portion 20*c* is arranged is referred to as a tension acting portion 20*d*.

Figure 4:
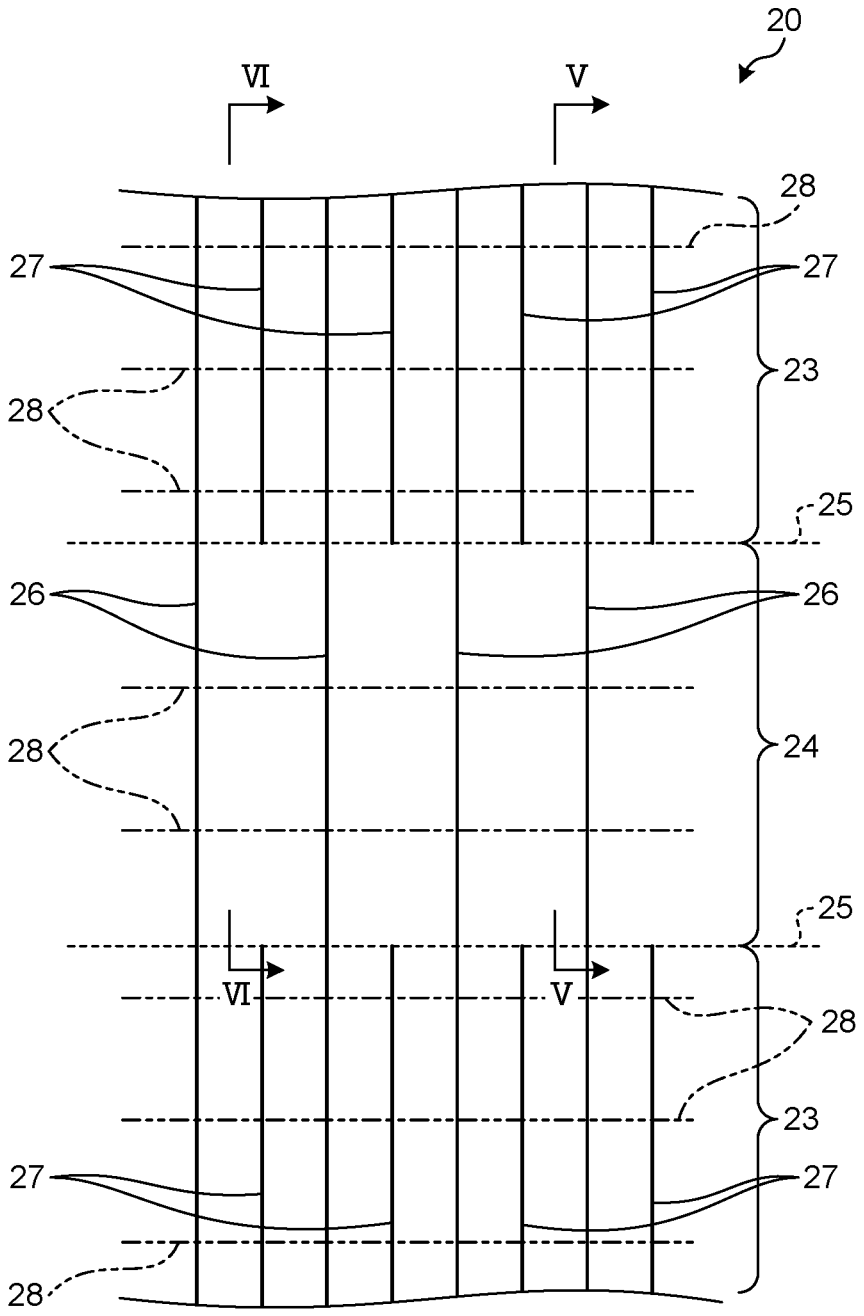
FIG. 4 is an enlarged view of a portion A illustrated in FIG. 3, and is a view schematically illustrating a linear body constituting an upper main body of the shoe according to the first embodiment.

FIG. 4 is an enlarged view of a portion A illustrated in FIG. 3, and is a view schematically illustrating a linear body constituting the upper main body 20 of the shoe 1 according to the first embodiment. As illustrated in FIG. 4, the upper main body 20 includes: a plurality of high-stretchability linear bodies 26 extending in the fore-rear direction; a plurality of low-stretchability linear bodies 27 extending in the fore-rear direction; and a plurality of reference linear bodies 28 extending in the foot width direction. The high-stretchability linear body 26, the low-stretchability linear body 27, and the reference linear body 28 are, for example, a yarn obtained by bundling a plurality of fibers, a linear resin, or the like. In FIG. 4, the reference linear body 28 is illustrated by a two-dot chain line for easy understanding.

The plurality of high-stretchability linear bodies 26 are provided at intervals in the foot width direction. The plurality of low-stretchability linear bodies 27 are provided at intervals in the foot width direction. The high-stretchability linear bodies 26 and the low-stretchability linear bodies 27 are provided at intervals in the foot width direction. In the present embodiment, one high-stretchability linear body 26 and one low-stretchability linear body 27 are alternately provided in the foot width direction. However, it is not intended to limit the arrangement of the high-stretchability linear bodies 26 and the low-stretchability linear bodies 27. The plurality of reference linear bodies 28 intersect the high-stretchability linear bodies 26 and the low-stretchability linear bodies 27, and are provided at intervals in the fore-rear direction. In the present embodiment, the high-stretchability linear body 26 is a first linear body, and the low-stretchability linear body 27 is a second linear body.

Figure 5:
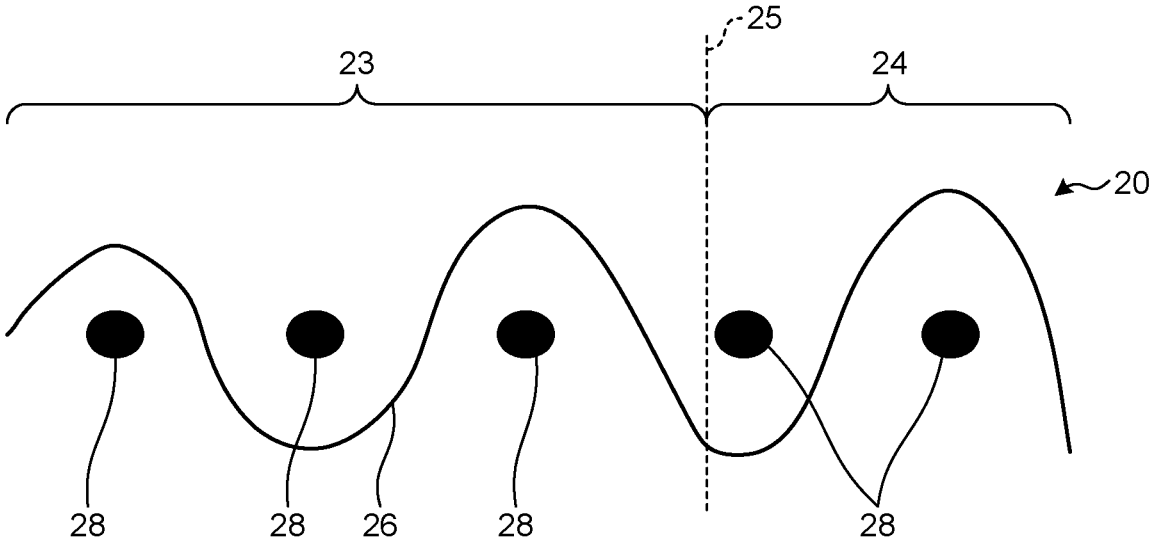
FIG. 5 is a cross-sectional view taken along line V-V illustrated in FIG. 4.

The high-stretchability linear body 26 is provided across the first region 23 and the second region 24. The high-stretchability linear body 26 has stretchability to stretch and contract in a stretching direction. FIG. 5 is a cross-sectional view taken along line V-V illustrated in FIG. 4. In the following description, a side facing a direction outward of the upper main body 20 in the reference linear body 28 is referred to as a "front side", and a side facing a direction inward of the upper main body 20 in the reference linear body 28 is referred to as a "back side". In the following description, a direction parallel to a direction from one of the front side and the back side toward another is referred to as a front-back direction. As illustrated in FIG. 5, the high-stretchability linear body 26 is provided so as to alternately pass the front side and the back side of the reference linear bodies 28 adjacent to each other in the first region 23 and the second region 24. The high-stretchability linear body 26 is provided so as to repeatedly pass the front side of one of the adjacent reference linear bodies 28, between the adjacent reference linear bodies 28, and the back side of another adjacent reference linear body 28 in this order.

Figure 6:
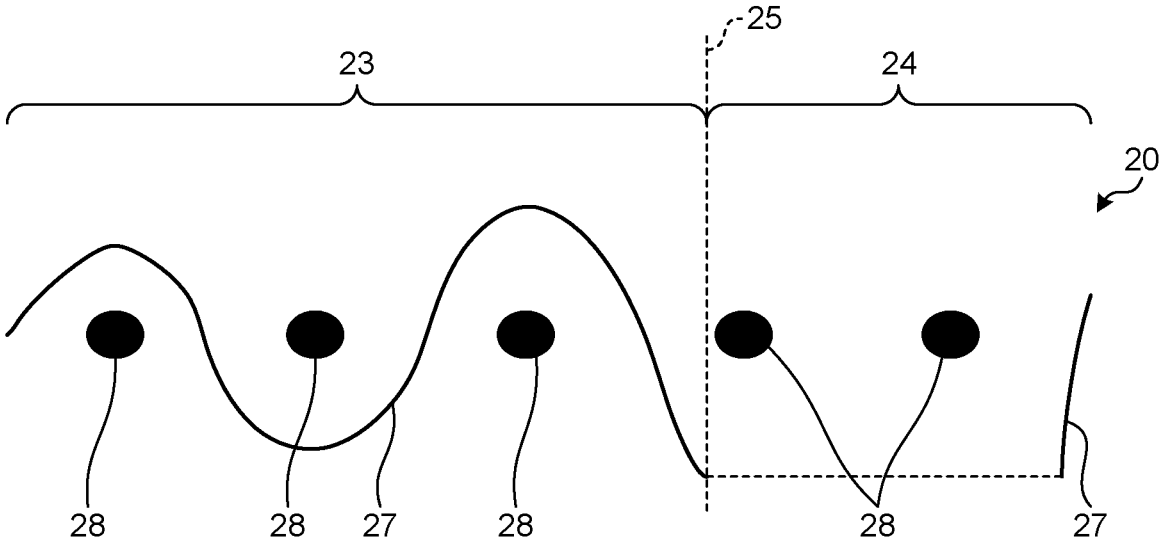
FIG. 6 is a cross-sectional view taken along line VI-VI illustrated in FIG. 4.

As illustrated in FIG. 4, the low-stretchability linear body 27 is provided in the first region 23 while avoiding the second region 24, and has an end located at a boundary portion 25 between the first region 23 and the second region 24. The low-stretchability linear body 27 has a property of being difficult to stretch in the stretching direction. FIG. 6 is a cross-sectional view taken along line VI-VI illustrated in FIG. 4. In FIG. 6, a removed portion of the low-stretchability linear body 27 is illustrated by a broken line. As illustrated in FIG. 6, the low-stretchability linear body 27 is provided so as to alternately pass the front side and the back side of the adjacent reference linear bodies 28 in the first region 23. The low-stretchability linear body 27 is provided so as to repeatedly pass the front side of one of the adjacent reference linear bodies 28, between the adjacent reference linear bodies 28, and the back side of another adjacent reference linear body 28 in this order. An end of the low-stretchability linear body 27 is located on the back side of the reference linear body 28. The low-stretchability linear body 27 is provided only in the first region 23, and is not provided in the second region 24.

Stretchability of the high-stretchability linear body 26 illustrated in FIG. 4 in the stretching direction is higher than stretchability of the low-stretchability linear body 27 in the stretching direction. That is, the high-stretchability linear body 26 and the low-stretchability linear body 27 have mutually different stretchability. By making a difference in materials used for the high-stretchability linear body 26 and the low-stretchability linear body 27, the stretchability of the high-stretchability linear body 26 and the stretchability of the low-stretchability linear body 27 can be made different from each other. For example, by using, as the material of the high-stretchability linear body 26, a polyurethane yarn, a single covered yarn (SCY) or a double covered yarn (DCY) covered with polyurethane, a thermoplastic elastomer yarn having high stretchability, or the like, and using a polyester yarn or the like as the material of the low-stretchability linear body 27, the stretchability of the high-stretchability linear body 26 and the stretchability of the low-stretchability linear body 27 can be made different from each other. Note that a material of the reference linear body 28 may be the same as the material of the high-stretchability linear body 26 or the low-stretchability linear body 27, or may be different from the materials of the high-stretchability linear body 26 and the low-stretchability linear body 27. Stretchability of the reference linear body 28 in the stretching direction may be the same as the stretchability of the high-stretchability linear body 26 or the low-stretchability linear body 27 in the stretching direction, or may be different from the stretchability of the high-stretchability linear body 26 and the low-stretchability linear body 27 in the stretching direction.

The first region 23 is a region where the high-stretchability linear body 26, the low-stretchability linear body 27, and the reference linear body 28 are provided. The second region 24 is a region where the high-stretchability linear body 26 and the reference linear body 28 are provided and the low-stretchability linear body 27 is not provided. Since the low-stretchability linear body 27 that is difficult to stretch and contract is provided in the first region 23 and is not provided in the second region 24, stretchability of the second region 24 is higher than stretchability of the first region 23. That is, the first region 23 and the second region 24 have mutually different stretchability.

Figure 7:
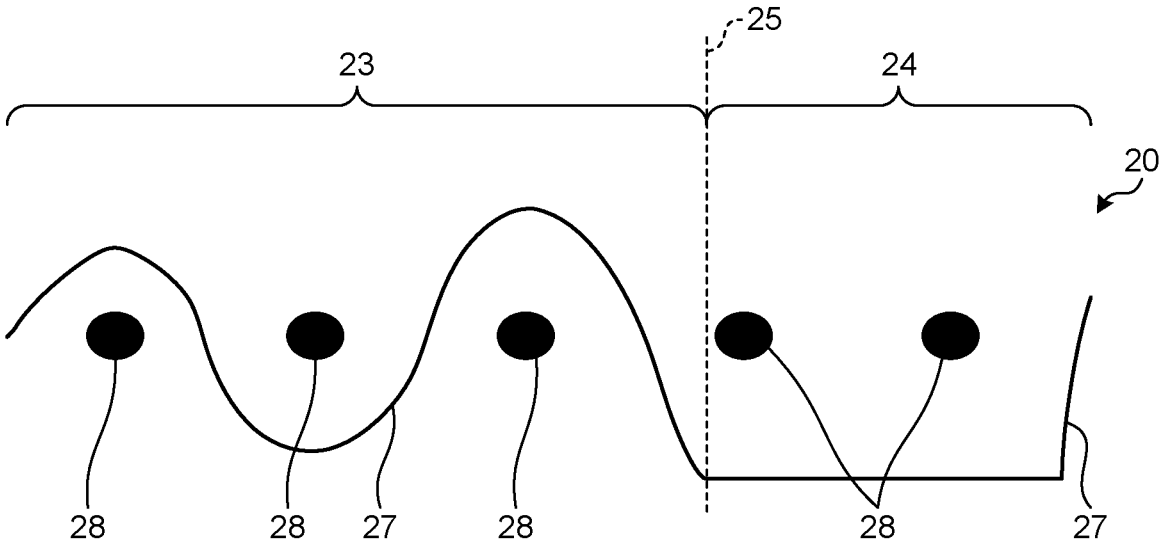
FIG. 7 is a cross-sectional view illustrating a state before a low-stretchability linear body is partially removed, and is a view corresponding to a cross-sectional view taken along line VI-VI illustrated in FIG. 4.

Next, with reference to FIGS. 6 and 7, a method of partially removing the low-stretchability linear body 27 will be described. FIG. 7 is a cross-sectional view illustrating a state before the low-stretchability linear body 27 is partially removed, and is a view corresponding to a cross-sectional view taken along line VI-VI illustrated in FIG. 4.

As illustrated in FIG. 7, before the low-stretchability linear body 27 is partially removed, a portion corresponding to the second region 24 in the low-stretchability linear body 27 is floated with respect to all reference linear bodies 28 provided at positions corresponding to the second region 24. In the present embodiment, a portion corresponding to the second region 24 in the low-stretchability linear body 27 is arranged to float on the back side with respect to all reference linear bodies 28 provided at positions corresponding to the second region 24, but may simply be arranged to float on either the front side or the back side with respect to all reference linear bodies 28 provided at positions corresponding to the second region 24. Floating the low-stretchability linear body 27 with respect to the reference linear body 28 means that the low-stretchability linear body 27 alternately passing the front side and the back side of the reference linear body 28 in the first region 23 is allowed to pass one side alone of the front side or the back side of the reference linear body 28 in the second region 24, and a separation distance between the low-stretchability linear body 27 and the reference linear body 28 in the front-back direction is made longer in the second region 24 than in the first region 23. Subsequently, a portion of the low-stretchability linear body 27 floating with respect to the reference linear body 28 is cut. A method for cutting the low-stretchability linear body 27 is not particularly limited, and may simply be appropriately selected from conventionally known methods. For example, the low-stretchability linear body 27 may be cut using a dedicated machine. This allows the low-stretchability linear body 27 to be partially removed as illustrated in FIG. 6.

Note that the low-stretchability linear body 27 may be partially removed by partially melting the low-stretchability linear body 27. For example, it is possible to partially melt and remove the low-stretchability linear body 27 by using a yarn that melts with a solvent, water, or heat, as the material of the low-stretchability linear body 27. When the low-stretchability linear body 27 is partially melted, a portion corresponding to the second region 24 in the low-stretchability linear body 27 may or may not be floated with respect to the reference linear body 28.

Next, effects of the shoe 1 according to the present embodiment will be described.

In the present embodiment, as illustrated in FIG. 1, the shoe 1 includes the upper main body 20 that covers an instep of a foot, and the upper main body 20 is formed with the first region 23 and the second region 24 adjacent to the first region 23. As illustrated in FIG. 4, the upper main body 20 includes: the high-stretchability linear body 26 provided across the first region 23 and the second region 24; and the low-stretchability linear body 27 provided in the first region 23 while avoiding the second region 24 and having an end located at the boundary portion 25 between the first region 23 and the second region 24. In addition, the high-stretchability linear body 26 and the low-stretchability linear body 27 have mutually different stretchability. With these configurations, since the high-stretchability linear body 26 is provided in both the first region 23 and the second region 24, while the low-stretchability linear body 27 is provided only in the first region 23, the stretchability of the first region 23 and the second region 24 can be made different from each other. In the present embodiment, since the low-stretchability linear body 27 that is difficult to stretch and contract is provided in the first region 23 and is not provided in the second region 24, the stretchability of the second region 24 is higher than the stretchability of the first region 23. In addition, it is not necessary to prepare a plurality of reinforcing materials having mutually different stretchability, separately from the upper main body 20 formed by a knitted fabric or a woven fabric. Therefore, stretchability of the upper main body 20 can be partially changed by simply adjusting an arrangement of the high-stretchability linear body 26 and the low-stretchability linear body 27 having mutually different stretchability. Therefore, the stretchability of the upper main body 20 can be partially changed with less materials than before. In particular, in the present embodiment, the stretchability of the upper main body 20 can be partially changed by a single material using linear bodies such as the high-stretchability linear body 26, the low-stretchability linear body 27, and the reference linear body 28, which makes it possible to reduce an environmental load by reducing the number of components constituting the upper main body 20.

In the present embodiment, as illustrated in FIG. 4, the high-stretchability linear body 26 is provided in both the first region 23 and the second region 24, while the low-stretchability linear body 27 is provided only in the first region 23. Therefore, by tightening the shoelace 22 illustrated in FIG. 2, a tension applied to the upper main body 20 is more easily transmitted to the first region 23 than to the second region 24, and air permeability of the second region 24 can be enhanced than that of the first region 23. That is, by simply changing the arrangement of the high-stretchability linear body 26 and the low-stretchability linear body 27, it is possible to adjust each portion requiring tension and air permeability in the upper main body 20.

In the present embodiment, as illustrated in FIG. 4, the high-stretchability linear body 26 is provided in both the first region 23 and the second region 24, while the low-stretchability linear body 27 is provided only in the first region 23. Therefore, rigidity of the first region 23 is higher than rigidity of the second region 24, and a weight of the second region 24 is lighter than a weight of the first region 23. That is, it is possible to reduce a weight of the upper main body 20 while securing a portion requiring rigidity in the upper main body 20.

In the present embodiment, as illustrated in FIGS. 6 and 7, by partially removing the low-stretchability linear body 27, it is possible to freely set portions having different stretchability, air permeability, weight, rigidity, and the like in the upper main body 20.

In the present embodiment, as illustrated in FIGS. 6 and 7, the stretchability and the like of the upper main body 20 can be partially changed by simply partially removing the low-stretchability linear body 27. Therefore, workability at a time of partially changing the stretchability and the like of the upper main body 20 can be improved as compared with a case of partially changing the stretchability and the like of the upper main body 20 by changing a yarn and knitting.

When the wearer of the shoe 1 illustrated in FIG. 2 moves, distortion such as contraction or twisting occurs in the skin of the midfoot portion of the foot, and the upper midfoot portion R2 illustrated in FIG. 3 is sheared and deformed in the foot width direction. In the present embodiment, since the second region 24 extends in the foot width direction of the upper main body 20 in the upper midfoot portion R2, the second region 24 is easily sheared and deformed in the foot width direction following the distortion of the skin of the foot. Therefore, foot contact of the upper main body 20 can be alleviated, and an occurrence of wrinkles in the upper main body 20 can be suppressed.

In the present embodiment, as illustrated in FIG. 3, the string passing portion 20*c* is arranged between the second regions 24 adjacent in the fore-rear direction. Thus, the second region 24 having high stretchability is present in front of and behind the tension acting portion 20*d* in the first region 23, so that each tension acting portion 20*d* can be deformed in accordance with a thickness of each portion of the foot of the wearer when the shoelace 22 is tightened. That is, a deformation amount of the first region 23 can be changed in front of and behind the second region 24.

When the low-stretchability linear body 27 is partially removed as illustrated in FIG. 7, there is a possibility that an end of the low-stretchability linear body 27 becomes dirty. In this regard, in the present embodiment, by cutting a portion of the low-stretchability linear body 27 floated on the back side with respect to the reference linear body 28, the end of the low-stretchability linear body 27 is located on the back side of the reference linear body 28 and is less likely to be visible from the outside of the upper main body 20, so that a design property of the upper main body 20 can be enhanced.

In the present embodiment, as illustrated in FIGS. 6 and 7, the portion corresponding to the second region 24 in the low-stretchability linear body 27 is removed. However, a portion corresponding to the second region 24 in the high-stretchability linear body 26 illustrated in FIG. 5 may be removed, without removal of the portion corresponding to the second region 24 in the low-stretchability linear body 27. In this case, the low-stretchability linear body 27 is a first linear body provided across the first region 23 and the second region 24. Further, the high-stretchability linear body 26 is a second linear body provided in the first region 23 while avoiding the second region 24 and having an end located at the boundary portion 25 between the first region 23 and the second region 24. Floating the high-stretchability linear body 26 with respect to the reference linear body 28 when the portion corresponding to the second region 24 in the high-stretchability linear body 26 is removed by floating with respect to the reference linear body 28 means that the high-stretchability linear body 26 alternately passing the front side and the back side of the reference linear body 28 in the first region 23 is allowed to pass one side alone of the front side or the back side of the reference linear body 28 in the second region 24, and a separation distance between the high-stretchability linear body 26 and the reference linear body 28 in the front-back direction is made longer in the second region 24 than in the first region 23.

In the present embodiment, as illustrated in FIG. 4, the high-stretchability linear body 26 and the low-stretchability linear body 27 extend in the fore-rear direction, and the reference linear body 28 extends in the foot width direction. However, the stretching directions of the high-stretchability linear body 26, the low-stretchability linear body 27, and the reference linear body 28 are not limited to the illustrated example. For example, the high-stretchability linear body 26 and the low-stretchability linear body 27 may extend in the foot width direction, and the reference linear body 28 may extend in the fore-rear direction. In this case, the plurality of high-stretchability linear bodies 26 are provided at intervals in the fore-rear direction. The plurality of low-stretchability linear bodies 27 are provided at intervals in the fore-rear direction. The plurality of reference linear bodies 28 are provided at intervals in the foot width direction. Then, by partially removing at least one of the high-stretchability linear body 26 or the low-stretchability linear body 27, the stretchability of the upper main body 20 can be partially changed. For example, when it is desired to promote shear deformation of the second region 24 in the foot width direction, it is sufficient to arrange the high-stretchability linear body 26 and the low-stretchability linear body 27 to extend in the foot width direction, and then remove a portion corresponding to the second region 24 in the low-stretchability linear body 27. That is, the stretching directions of the high-stretchability linear body 26, the low-stretchability linear body 27, and the reference linear body 28 may be appropriately changed according to the direction in which the second region 24 is desired to be deformed. When cutting is selected as a method of removal, it is sufficient to partially float at least one of the high-stretchability linear body 26 or the low-stretchability linear body 27 with respect to the reference linear body 28, and cut the floated portion.

In the present embodiment, the number of the second regions 24 illustrated in FIG. 3 is four on each of both sides in the foot width direction across the throat portion 20*b*, but may be one or a plural number other than four. Further, the second region 24 extends in the foot width direction in the present embodiment, but may extend obliquely with respect to the foot width direction. In addition, each of the second regions 24 is formed in one piece in the present embodiment, but may be divided into a plurality of pieces in the fore-rear direction or the foot width direction, or may be divided into a plurality of pieces in the fore-rear direction and the foot width direction. In addition, the number, a shape, and a position of the second regions 24 are laterally symmetrical on both sides in the foot width direction across the throat portion 20*b* in the present embodiment, but may be laterally asymmetrical. In addition, the string passing portion 20*c* is arranged to be shifted from the second region 24 in the fore-rear direction in the present embodiment, but may be arranged at a position overlapping the second region 24 in the up-down direction.

Although one high-stretchability linear body 26 and one low-stretchability linear body 27 illustrated in FIG. 4 are alternately provided in the foot width direction, the arrangement of the high-stretchability linear body 26 and the low-stretchability linear body 27 is not limited to the illustrated example. For example, one high-stretchability linear body 26 may be arranged for every two low-stretchability linear bodies 27 being arranged.

Second Embodiment

Figure 8:
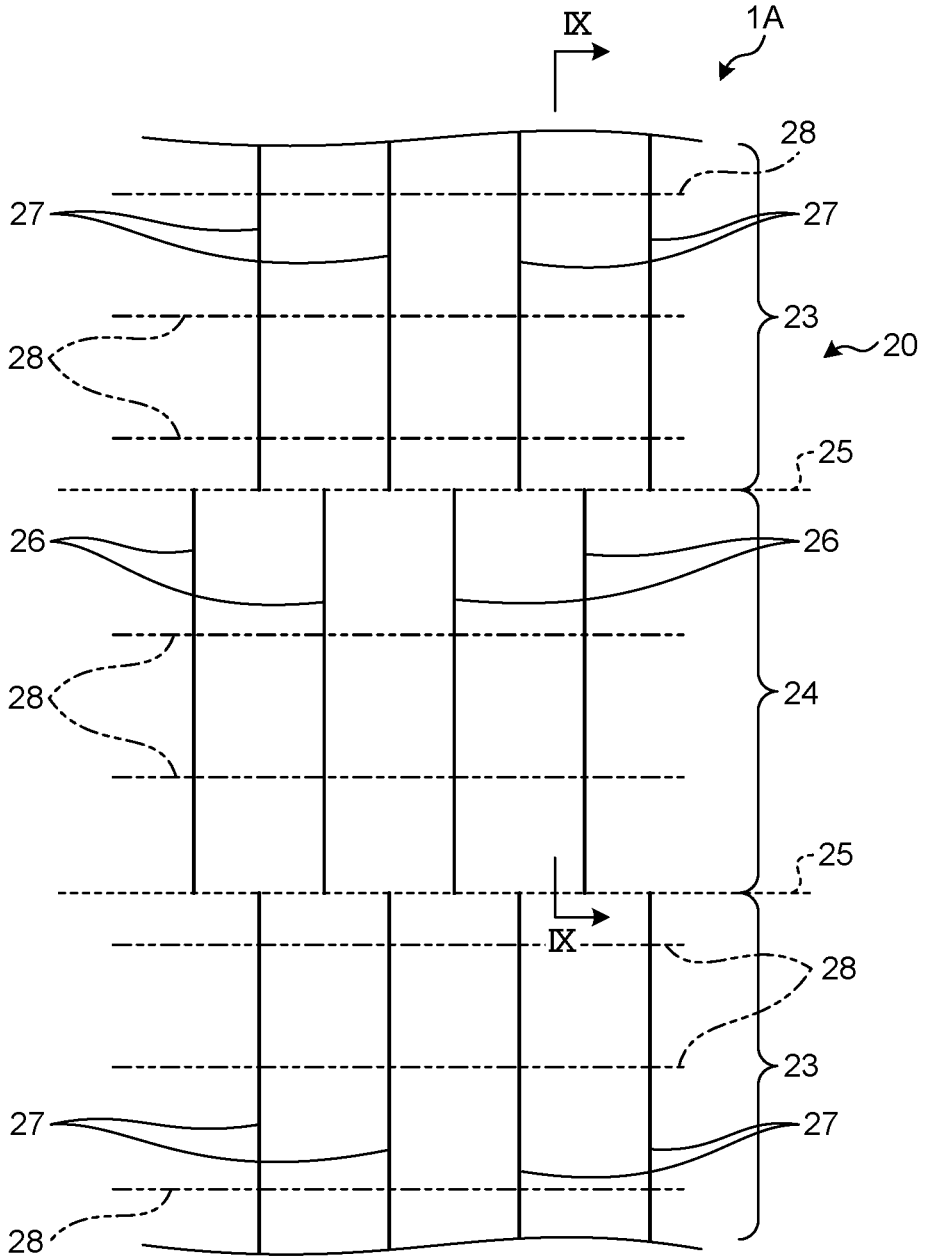
FIG. 8 is a view schematically illustrating a linear body constituting an upper main body of a shoe according to a second embodiment, and is a view corresponding to an enlarged view of the portion A illustrated in FIG. 3.
Figure 9:
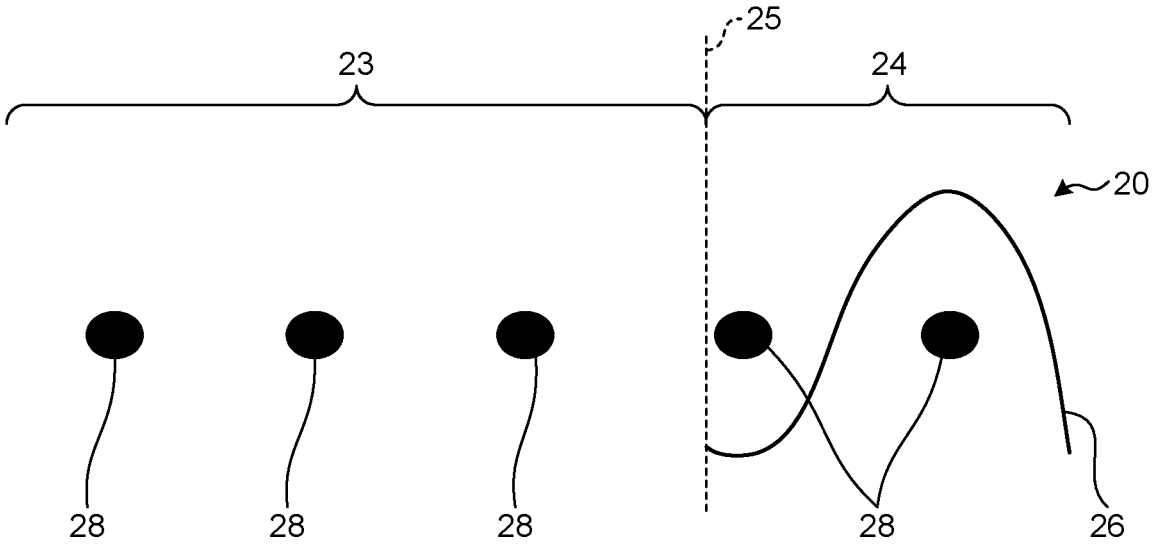
FIG. 9 is a cross-sectional view taken along line IX-IX illustrated in FIG. 8.

FIG. 8 is a view schematically illustrating a linear body constituting an upper main body 20 of a shoe 1A according to a second embodiment, and is a view corresponding to an enlarged view of the portion A illustrated in FIG. 3. FIG. 9 is a cross-sectional view taken along line IX-IX illustrated in FIG. 8. The shoe 1A according to the second embodiment is different from the shoe 1 according to the first embodiment in that a high-stretchability linear body 26 is provided only in a second region 24.

In the present embodiment, the high-stretchability linear body 26 is a first linear body provided only in the second region 24. Further, a low-stretchability linear body 27 is a second linear body provided in a first region 23 while avoiding the second region 24. A portion corresponding to the first region 23 in the high-stretchability linear body 26 is removed, and a portion corresponding to the second region 24 in the low-stretchability linear body 27 is removed. Floating the high-stretchability linear body 26 with respect to a reference linear body 28 when the portion corresponding to the first region 23 of the high-stretchability linear body 26 is removed by floating with respect to the reference linear body 28 means that the high-stretchability linear body 26 alternately passing the front side and the back side of the reference linear body 28 in the second region 24 is allowed to pass one side alone of the front side or the back side of the reference linear body 28 in the first region 23, and a separation distance between the high-stretchability linear body 26 and the reference linear body 28 in the front-back direction is made longer in the first region 23 than in the second region 24. Floating the low-stretchability linear body 27 with respect to the reference linear body 28 when the portion corresponding to the second region 24 in the low-stretchability linear body 27 is removed by floating with respect to the reference linear body 28 has meaning similar to that in the first embodiment described above.

The present embodiment can achieve effects similar to those of the first embodiment described above. That is, since the high-stretchability linear body 26 is provided only in the second region 24 and the low-stretchability linear body 27 is provided only in the first region 23, stretchability of the first region 23 and the second region 24 can be made different from each other. In the present embodiment, since the low-stretchability linear body 27 that is difficult to stretch and contract is provided in the first region 23 and is not provided in the second region 24, the stretchability of the second region 24 is higher than the stretchability of the first region 23.

Note that the high-stretchability linear bodies 26 may be provided only in the first region 23, and the low-stretchability linear bodies 27 may be provided only in the second region 24. In this case, the low-stretchability linear body 27 is a first linear body provided only in the second region 24. Further, the high-stretchability linear body 26 is a second linear body provided in the first region 23 while avoiding the second region 24 and having an end located at a boundary portion 25 between the first region 23 and the second region 24. That is, a portion corresponding to the second region 24 in the high-stretchability linear body 26 is removed, and a portion corresponding to the first region 23 in the low-stretchability linear body 27 is removed. By doing in this way, since the low-stretchability linear body 27 that is difficult to stretch and contract is provided in the second region 24 and is not provided in the first region 23, the stretchability of the first region 23 is higher than the stretchability of the second region 24. Floating the low-stretchability linear body 27 with respect to the reference linear body 28 when the portion corresponding to the first region 23 of the low-stretchability linear body 27 is removed by floating with respect to the reference linear body 28 means that the low-stretchability linear body 27 alternately passing the front side and the back side of the reference linear body 28 in the second region 24 is allowed to pass one side alone of the front side or the back side of the reference linear body 28 in the first region 23, and a separation distance between the low-stretchability linear body 27 and the reference linear body 28 in the front-back direction is made longer in the first region 23 than in the second region 24. Floating the high-stretchability linear body 26 with respect to the reference linear body 28 when the portion corresponding to the second region 24 in the high-stretchability linear body 26 is removed by floating with respect to the reference linear body 28 has meaning similar to that in the first embodiment described above.

Third Embodiment

Figure 10:
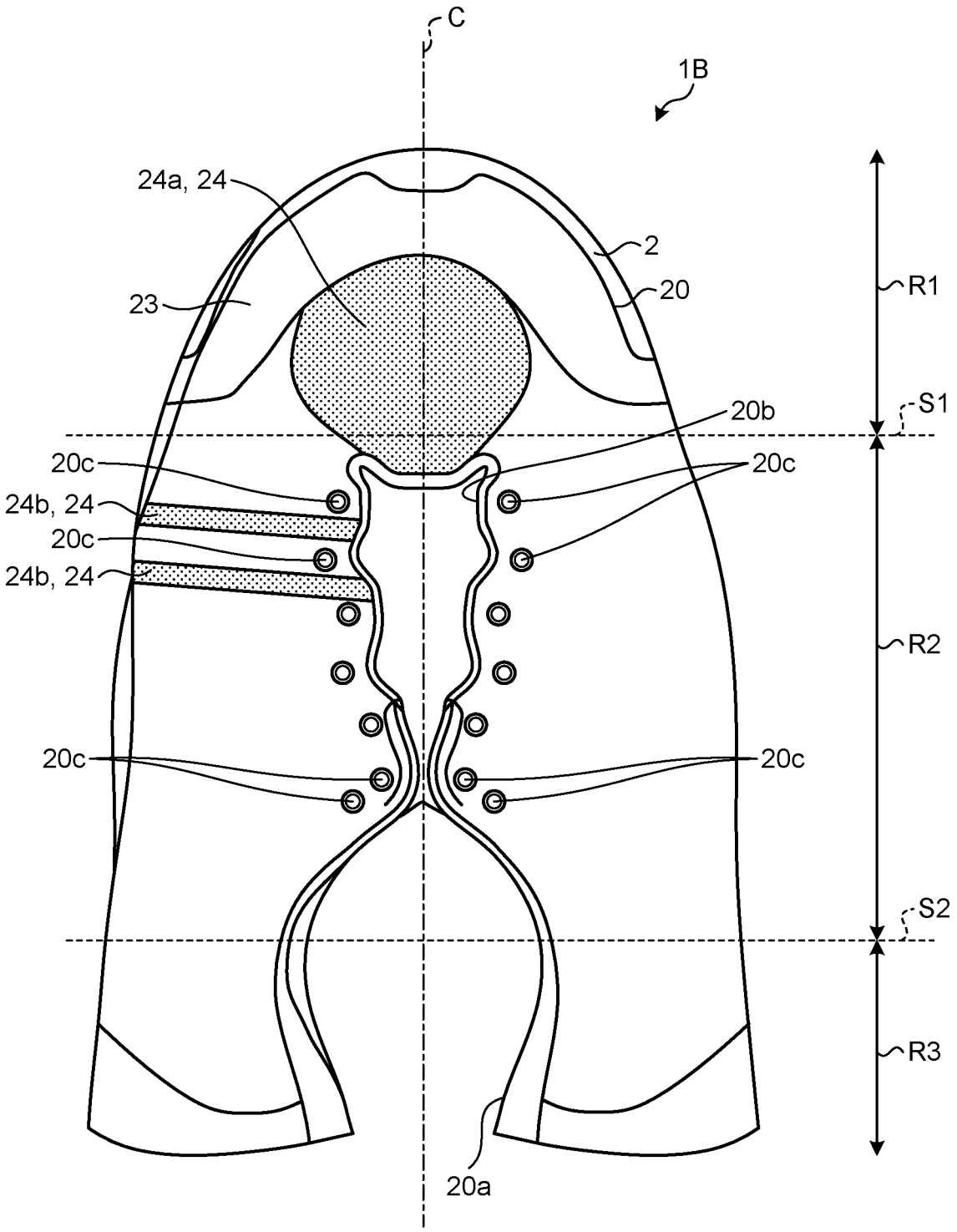
FIG. 10 is developed view illustrating an upper main body of a shoe according to a third embodiment.

FIG. 10 is a developed view illustrating an upper main body 20 of a shoe 1B according to a third embodiment. The shoe 1B according to the third embodiment is different from the shoe 1 according to the first embodiment in a position of a second region 24.

The second region 24 is formed in an upper forefoot portion R1 and an upper midfoot portion R2 in the present embodiment. The second region 24 includes a front region 24*a* provided adjacent to a throat portion 20*b* in forward of the throat portion 20*b* and a side region 24*b* provided only on one side in the foot width direction across the throat portion 20*b*. The front region 24*a* is provided across the upper forefoot portion R1 and the upper midfoot portion R2. A plan view shape of the front region 24*a* is not particularly limited, but is substantially circular in the present embodiment.

A position of the side region 24*b* may be on a medial foot side of the throat portion 20*b*, but is on a lateral foot side of the throat portion 20*b* in the present embodiment. The number of the side regions 24*b* is not particularly limited, but is two in the present embodiment. The two side regions 24*b* are provided at intervals in the fore-rear direction. Each side region 24*b* extends in the foot width direction of the upper main body 20 in the upper midfoot portion R2. Each side region 24*b* extends from an edge of the throat portion 20*b* to a lower edge of the upper main body 20. A plan view shape of each side region 24*b* is not particularly limited, but is a band shape longer in the foot width direction than in the fore-rear direction, in the present embodiment. Between the side regions 24*b* adjacent in the fore-rear direction, one string passing portion 20*c* is arranged.

The present embodiment can achieve effects similar to those of the first embodiment described above. Furthermore, in the present embodiment, the second region 24 includes the side region 24*b* provided only on one side in the foot width direction across the throat portion 20*b*, so that the second region 24 is arranged laterally asymmetrically. Therefore, the structure is suitable for a case of performing a sport or the like where it is desired to easily stretch and contract one side of the upper main body 20 in the foot width direction across the throat portion 20*b* and to make it difficult to stretch and contract another side in the foot width direction. Note that the front region 24*a* and each of the side regions 24*b* are formed in one piece in the present embodiment, but may be divided into a plurality of pieces in the fore-rear direction or the foot width direction, or may be divided into a plurality of pieces in the fore-rear direction and the foot width direction.

Fourth Embodiment

Figure 11:
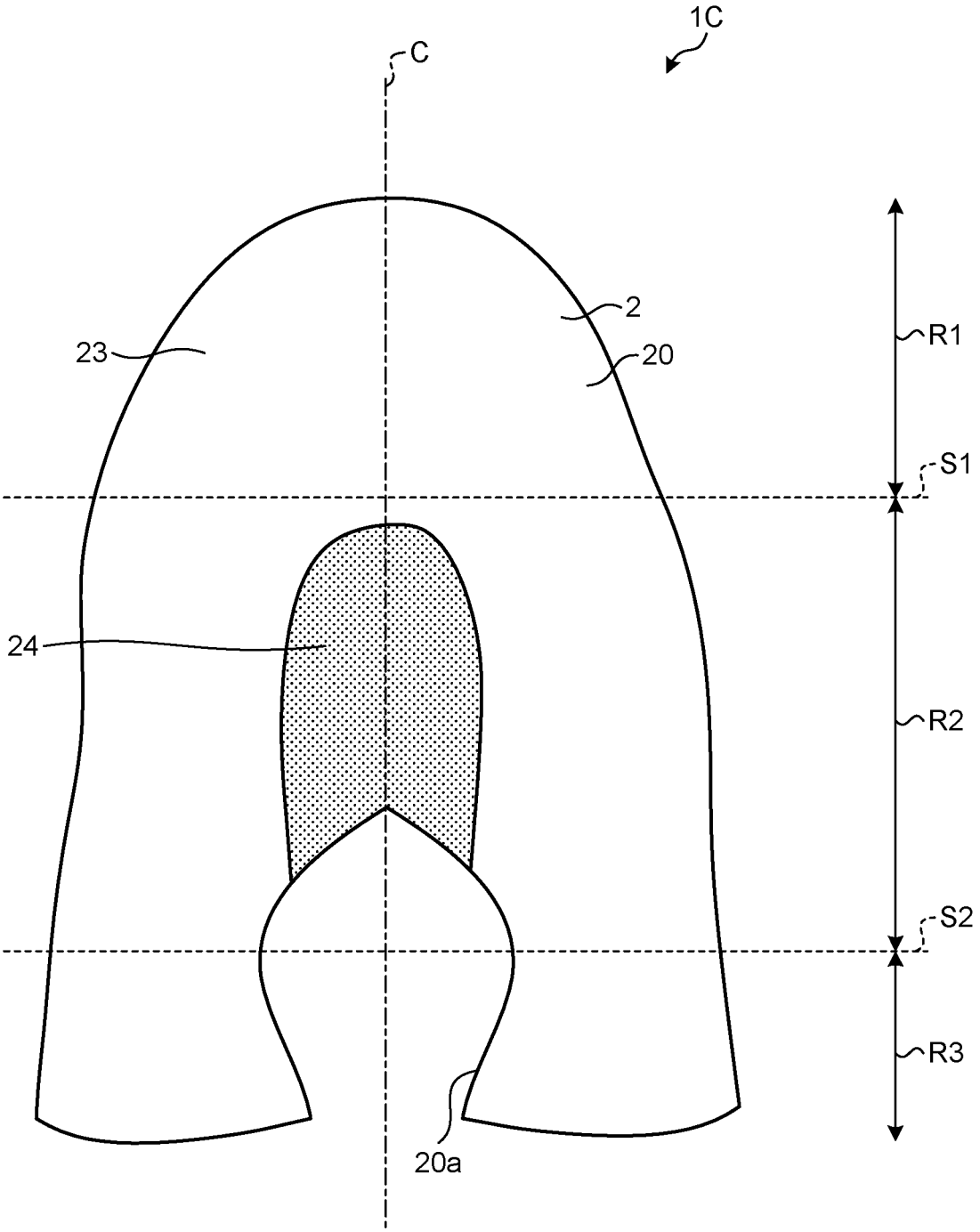
FIG. 11 is a developed view illustrating an upper main body of a shoe according to a fourth embodiment.

FIG. 11 is a developed view illustrating an upper main body 20 of a shoe 1C according to a fourth embodiment. The shoe 1C according to the fourth embodiment is different from the shoe 1 according to the first embodiment in a position of a second region 24 and in that an upper 2 has a monosock structure.

As illustrated in FIG. 11, the upper 2 has a monosock structure in which a portion corresponding to the shoe tongue 21 of the first embodiment is integrated with an ankle portion of the upper main body 20. In the present embodiment, the second region 24 is formed in an upper midfoot portion R2. The second region 24 is formed adjacent to a foot insertion opening 20*a* in forward of the foot insertion opening 20*a*. The second region 24 is provided in a portion corresponding to the shoe tongue 21 of the first embodiment.

The present embodiment can achieve effects similar to those of the first embodiment described above. Furthermore, in the present embodiment, the second region 24 is formed adjacent to the foot insertion opening 20*a* in forward of the foot insertion opening 20*a*, so that the second region 24 is a portion corresponding to the shoe tongue 21, and thus a monosock structure can be realized by one material which is a linear body. Moreover, the second region 24 is formed in one piece in the present embodiment, but may be divided into a plurality of pieces in the fore-rear direction or the foot width direction, or may be divided into a plurality of pieces in the fore-rear direction and the foot width direction. Furthermore, the second region 24 may be formed to be laterally asymmetric.

Fifth Embodiment

Figure 12:
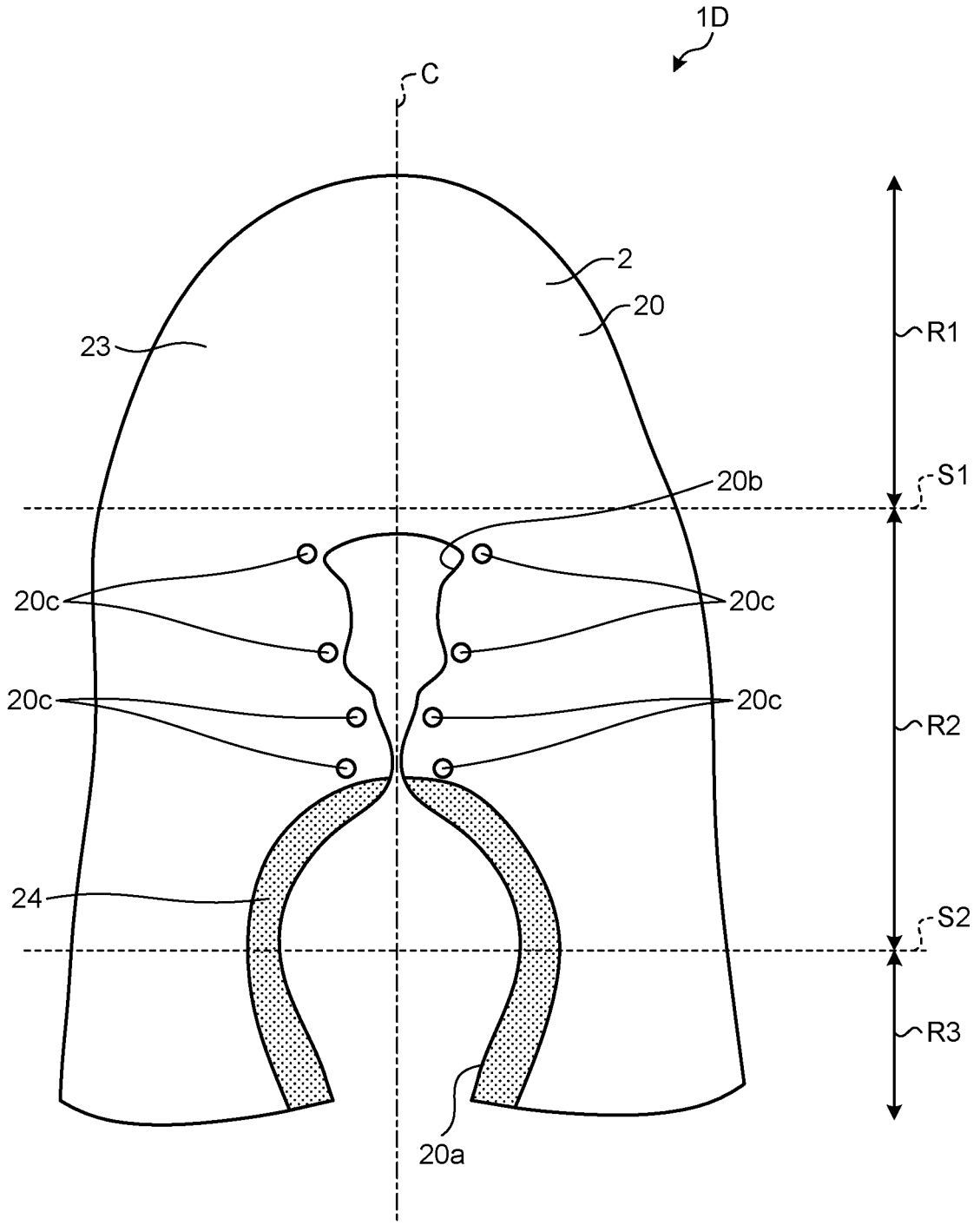
FIG. 12 is a developed view illustrating an upper main body of a shoe according to a fifth embodiment.

FIG. 12 is a developed view illustrating an upper main body 20 of a shoe 1D according to a fifth embodiment. The shoe 1D according to the fifth embodiment is different from the shoe 1 according to the first embodiment in a position of a second region 24.

The second region 24 is formed in an upper midfoot portion R2 and an upper rearfoot portion R3 in the present embodiment. The second region 24 extends along an edge of a foot insertion opening 20*a*. In a state where the upper main body 20 illustrated in FIG. 12 is assembled, the second region 24 is formed from an edge on a lateral foot side of a throat portion 20*b* to an edge on a medial foot side of the throat portion 20*b* through a terminal edge on the heel side of the upper rearfoot portion R3. The second region 24 extends so as to surround the foot insertion opening 20*a*.

The present embodiment can achieve effects similar to those of the first embodiment described above. Furthermore, in the present embodiment, since the second region 24 extends along the edge of the foot insertion opening 20*a*, the second region 24 deforms following a movement of the foot of the wearer, so that fitting between the foot and the edge of the foot insertion opening 20*a* can be enhanced. Moreover, the second region 24 is formed in one piece in the present embodiment, but may be divided into a plurality of pieces in the fore-rear direction or the foot width direction, or may be divided into a plurality of pieces in the fore-rear direction and the foot width direction. Furthermore, the second region 24 may be formed to be laterally asymmetric.

Sixth Embodiment

Figure 13:
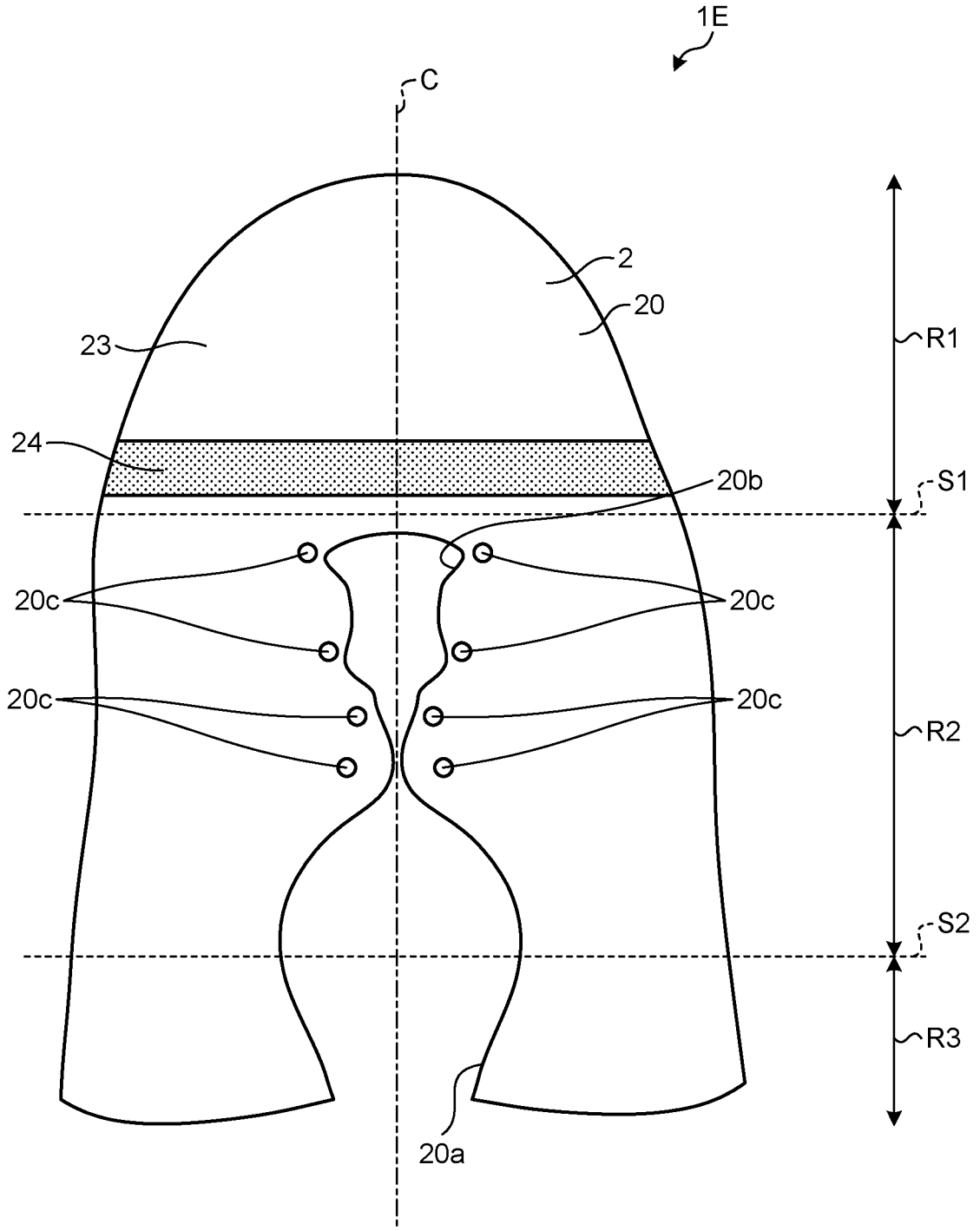
FIG. 13 is a developed view illustrating an upper main body of a shoe according to a sixth embodiment.

FIG. 13 is a developed view illustrating an upper main body 20 of a shoe 1E according to a sixth embodiment. The shoe 1E according to the sixth embodiment is different from the shoe 1 according to the first embodiment in a position of a second region 24.

The second region 24 is formed in an upper forefoot portion R1 in the present embodiment. The second region 24 extends in the foot width direction of the upper main body 20 in the upper forefoot portion R1. The second region 24 is formed from a lower edge on a lateral foot side of the upper forefoot portion R1 to a lower edge on a medial foot side of the upper forefoot portion R1 through forward of a throat portion 20*b*.

The present embodiment can achieve effects similar to those of the first embodiment described above. When a motion of floating an upper rearfoot portion R3 from the ground is performed with the upper forefoot portion R1 illustrated in FIG. 13 in contact with the ground, the forefoot of the foot is bent to generate a bent portion in the upper forefoot portion R1. In this regard, in the present embodiment, since the second region 24 extends in the foot width direction of the upper main body 20 in the upper forefoot portion R1, the second region 24 is easily bent following the bending of the foot. Therefore, foot contact of the upper main body 20 can be alleviated, and an occurrence of wrinkles in the upper main body 20 can be suppressed. Moreover, the second region 24 is formed in one piece in the present embodiment, but may be divided into a plurality of pieces in the fore-rear direction or the foot width direction, or may be divided into a plurality of pieces in the fore-rear direction and the foot width direction. Furthermore, the second region 24 may be formed to be laterally asymmetric.

Seventh Embodiment

Figure 14:
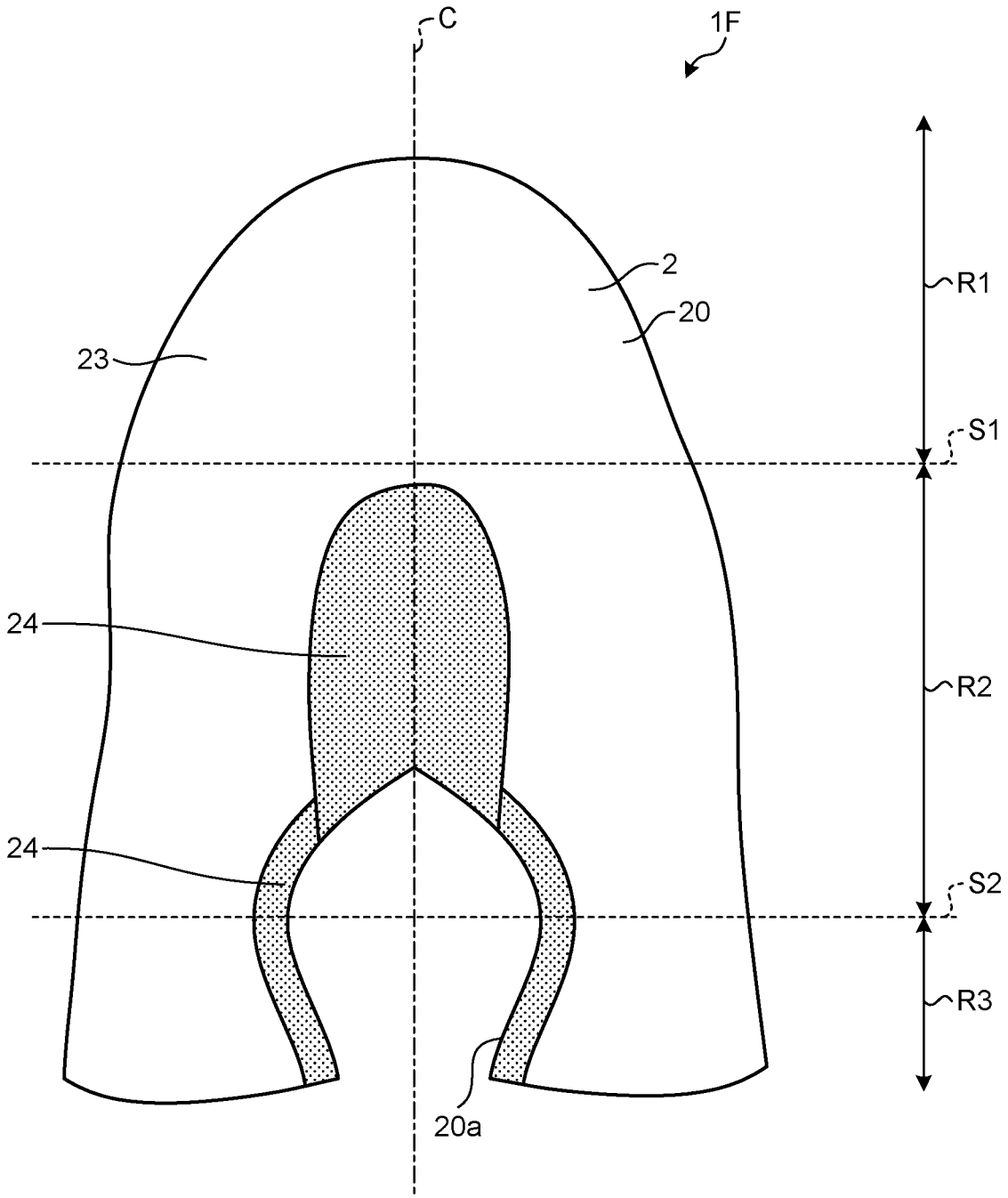
FIG. 14 is a developed view illustrating an upper main body of a shoe according to a seventh embodiment.

FIG. 14 is a developed view illustrating an upper main body 20 of a shoe 1F according to a seventh embodiment. The shoe 1F according to the seventh embodiment is different from the shoe 1 according to the first embodiment in an arrangement of a second region 24.

The second region 24 of the shoe 1F according to the present embodiment has a configuration in which the second region 24 of the shoe 1C according to the fourth embodiment and the second region 24 of the shoe 1D according to the fifth embodiment are combined. An upper 2 has a monosock structure in which a portion corresponding to the shoe tongue 21 of the first embodiment is integrated with an ankle portion of the upper main body 20. The second region 24 is formed adjacent to a foot insertion opening 20*a* in forward of the foot insertion opening 20*a*. Furthermore, the second region 24 extends along an edge of the foot insertion opening 20*a*.

The present embodiment can achieve effects similar to those of the first, fourth, and fifth embodiments described above. In the present embodiment, the second region 24 is configured by combining the second regions 24 of the fourth and fifth embodiments, but may be configured by combining two or more of the second regions 24 of the first and third to sixth embodiments.

Eighth Embodiment

Figure 15:
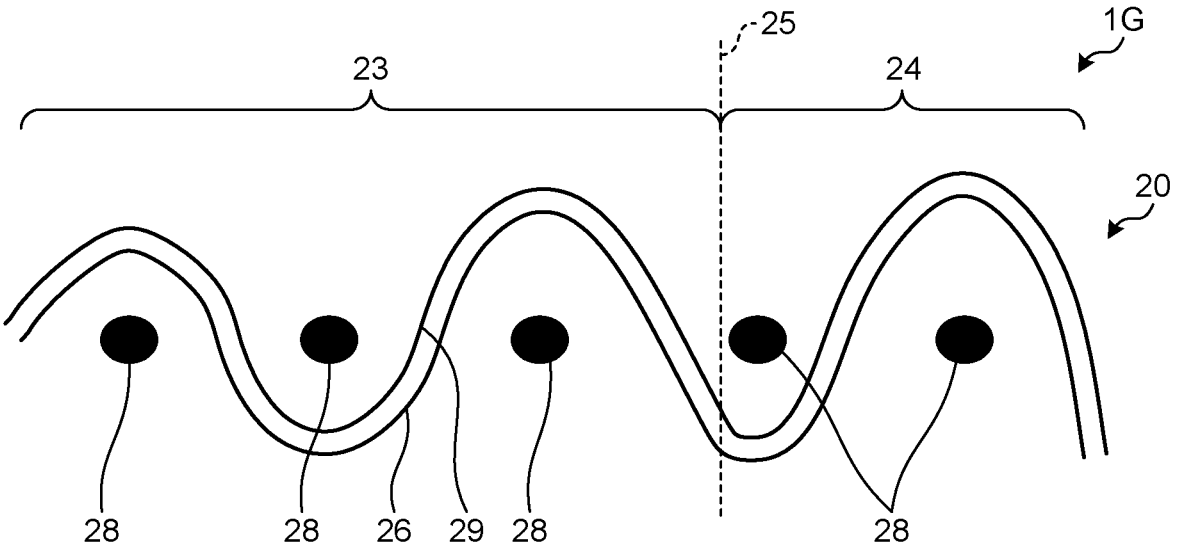
FIG. 15 is a cross-sectional view illustrating an upper main body of a shoe according to an eighth embodiment, and is a view corresponding to a cross-sectional view taken along line V-V illustrated in FIG. 4.
Figure 16:
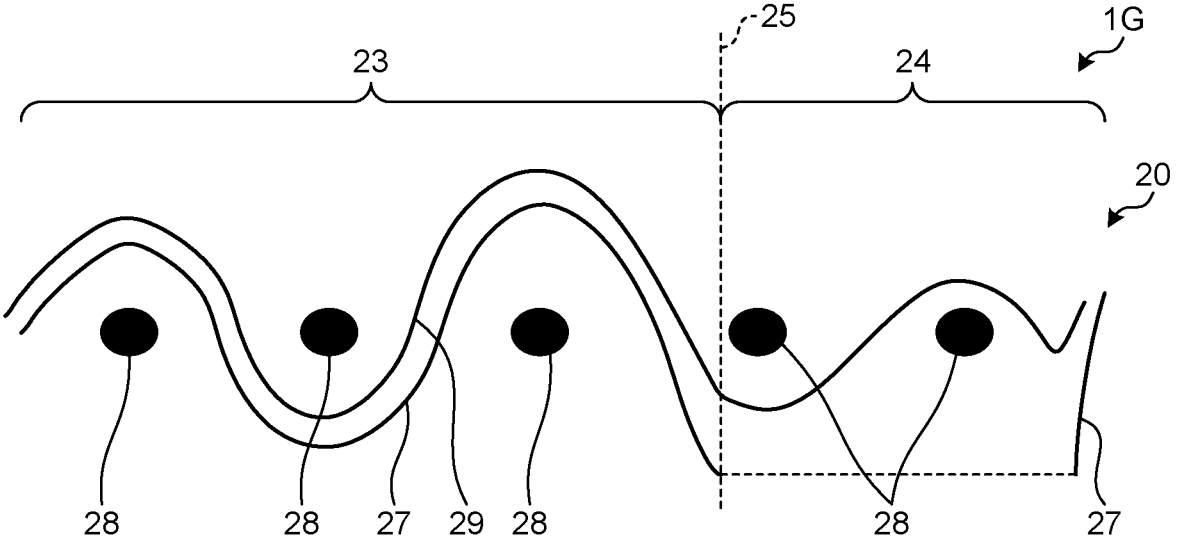
FIG. 16 is a cross-sectional view illustrating the upper main body of the shoe according to the eighth embodiment, and is a view corresponding to a cross-sectional view taken along line VI-VI illustrated in FIG. 4.

FIG. 15 is a cross-sectional view illustrating an upper main body 20 of a shoe 1G according to an eighth embodiment, and is a view corresponding to a cross-sectional view taken along line V-V illustrated in FIG. 4. FIG. 16 is a cross-sectional view illustrating the upper main body 20 of the shoe 1G according to the eighth embodiment, and is a view corresponding to a cross-sectional view taken along line VI-VI illustrated in FIG. 4. The shoe 1G according to the eighth embodiment is different from the shoe 1 according to the first embodiment in that an additional linear body 29 is further included. That is, in the shoe 1 according to the first embodiment, the number of linear bodies overlapping in the up-down direction is two at maximum, but in the shoe 1G according to the present embodiment, the number of linear bodies overlapping in the up-down direction is three at maximum.

As illustrated in FIGS. 15 and 16, the upper main body 20 includes a plurality of additional linear bodies 29 extending in an identical direction to a stretching direction of a high-stretchability linear body 26 and a low-stretchability linear body 27. The additional linear body 29 is, for example, a yarn obtained by bundling a plurality of fibers, a linear resin, or the like. Although not illustrated, the plurality of additional linear bodies 29 are provided at intervals in the stretching direction of a reference linear body 28. One additional linear body 29 is arranged above each of the high-stretchability linear body 26 and the low-stretchability linear body 27. The plurality of reference linear bodies 28 intersect the high-stretchability linear body 26, the low-stretchability linear body 27, and the additional linear body 29. In the present embodiment, the high-stretchability linear body 26 is a first linear body provided across a first region 23 and a second region 24. Further, the low-stretchability linear body 27 is a second linear body provided in the first region 23 while avoiding the second region 24 and having an end located at a boundary portion 25 between the first region 23 and the second region 24.

The additional linear body 29 is provided across the first region 23 and the second region 24. Note that a material of the additional linear body 29 may be the same as a material of the high-stretchability linear body 26 or the low-stretchability linear body 27, or may be different from the materials of the high-stretchability linear body 26 and the low-stretchability linear body 27. Stretchability of the additional linear body 29 in the stretching direction may be the same as the stretchability of the high-stretchability linear body 26 or the low-stretchability linear body 27 in the stretching direction, or may be different from the stretchability of the high-stretchability linear body 26 and the low-stretchability linear body 27 in the stretching direction. The additional linear body 29 is provided so as to alternately pass the front side and the back side of the reference linear bodies 28 adjacent to each other in the first region 23 and the second region 24. The high-stretchability linear body 26 is provided so as to repeatedly pass the front side of one of the adjacent reference linear bodies 28, between the adjacent reference linear bodies 28, and the back side of another adjacent reference linear body 28 in this order.

The first region 23 is a region where the high-stretchability linear body 26, the low-stretchability linear body 27, the additional linear body 29, and the reference linear body 28 are provided. The second region 24 is a region where the high-stretchability linear body 26, the additional linear body 29, and the reference linear body 28 are provided and the low-stretchability linear body 27 is not provided. Note that the additional linear body 29 may be removed in the second region 24 similarly to the low-stretchability linear body 27. In this case, the additional linear body 29 is provided in the first region 23 while avoiding the second region 24, and has an end located at the boundary portion 25 between the first region 23 and the second region 24.

The present embodiment can achieve effects similar to those of the first embodiment described above. When the number of linear bodies overlapping in the up-down direction is set to three at maximum as in the present embodiment, stretchability of the upper main body 20 can be changed in multiple stages of three or more stages, by changing the arrangement of the linear bodies. For example, by providing: a region where the low-stretchability linear body 27 and the additional linear body 29 are partially removed and the high-stretchability linear body 26 and the reference linear body 28 are present; a region where the additional linear body 29 is partially removed and the high-stretchability linear body 26, the low-stretchability linear body 27, and the reference linear body 28 are present; and a region where the high-stretchability linear body 26, the low-stretchability linear body 27, the additional linear body 29, and the reference linear body 28 are present, the stretchability of the upper main body 20 can be changed in three stages. In the present embodiment, the maximum number of linear bodies overlapping in the up-down direction is three, but may be four or more. By doing in this way, the stretchability of the upper main body 20 can be changed in multiple stages of four or more stages.

In the upper according to the present invention, there is an effect of being able to partially change stretchability of the upper with less materials than before.

The configuration illustrated in the above embodiment illustrates one example of the contents of the present invention and can be combined with another known technique, and it is also possible to omit and change a part of the configuration without departing from the subject matter of the present invention.

What is claimed is:

1. An upper comprising:

an upper main body configured to cover an instep of a foot, wherein a first region and a second region adjacent to the first region are formed in the upper main body, the upper main body includes: a plurality of first linear bodies provided across the first region and the second region or provided in the second region and not in the first region; and a plurality of second linear bodies provided in the first region while avoiding the second region and having an end located at a boundary portion between the first region and the second region, the first linear bodies have different stretchability than the second linear bodies, the upper main body further comprises a plurality of reference linear bodies, the plurality of first linear bodies and the plurality of second linear bodies extend in one of a fore-rear direction or a foot-width direction, and the plurality of reference linear bodies extend in the other of the fore-rear direction or the foot-width direction, the plurality of first linear bodies alternately pass a front side and a back side of the reference linear bodies in the first region and second region or in the second region and not in the first region, and the plurality of second linear bodies alternately pass the front side and the back side of the reference linear bodies in the first region.

2. The upper according to claim 1, wherein the upper main body includes: an upper forefoot portion configured to cover a forefoot portion of a foot of a wearer; an upper midfoot portion configured to cover a midfoot portion of the foot; and an upper rearfoot portion configured to cover a hindfoot portion of the foot, a foot insertion opening for insertion of a foot is formed in the upper main body, and the second region is formed in at least one of the upper forefoot portion, the upper midfoot portion, or the upper rearfoot portion.

3. The upper according to claim 2, wherein the second region extends in a foot width direction of the upper main body in at least one of the upper forefoot portion or the upper midfoot portion.

4. The upper according to claim 2, wherein the second region extends along an edge of the foot insertion opening.

5. The upper according to claim 3, wherein the second region extends along an edge of the foot insertion opening.

6. The upper according to claim 2, wherein the second region is formed adjacent to the foot insertion opening in forward of the foot insertion opening.

7. The upper according to claim 3, wherein the second region is formed adjacent to the foot insertion opening in forward of the foot insertion opening.

8. The upper according to claim 4, wherein the second region is formed adjacent to the foot insertion opening in forward of the foot insertion opening.

9. The upper according to claim 5, wherein the second region is formed adjacent to the foot insertion opening in forward of the foot insertion opening.

10. A shoe comprising:

the upper according to claim 1; and a sole located below the upper.

11. An upper comprising:

an upper main body configured to cover an instep of a foot, wherein a first region and a second region adjacent to the first region are formed in the upper main body, the upper main body includes: a plurality of first linear bodies provided across the first region and the second region or provided in the second region and not in the first region; and a plurality of second linear bodies provided in the first region while avoiding the second region and having an end located at a boundary portion between the first region and the second region, the first linear bodies have different stretchability than the second linear bodies, the upper main body further comprises a plurality of reference linear bodies, the plurality of first linear bodies and the plurality of second linear bodies extend in one of a fore-rear direction or a foot-width direction, and the plurality of reference linear bodies extend in the other of the fore-rear direction or the foot-width direction, and the ends of the plurality of second linear bodies at the boundary portion between the first region and the second region are cut or melted ends obtained by cutting or melting to remove portions of the second linear bodies that were floated with respect to the plurality of reference linear bodies at positions corresponding to the second region.

12. The upper according to claim 11, wherein the upper main body includes: an upper forefoot portion configured to cover a forefoot portion of a foot of a wearer; an upper midfoot portion configured to cover a midfoot portion of the foot; and an upper rearfoot portion configured to cover a hindfoot portion of the foot, a foot insertion opening for insertion of a foot is formed in the upper main body, and the second region is formed in at least one of the upper forefoot portion, the upper midfoot portion, or the upper rearfoot portion.

13. The upper according to claim 12, wherein the second region extends in a foot width direction of the upper main body in at least one of the upper forefoot portion or the upper midfoot portion.

14. The upper according to claim 12, wherein the second region extends along an edge of the foot insertion opening.

15. The upper according to claim 13, wherein the second region extends along an edge of the foot insertion opening.

16. The upper according to claim 12, wherein the second region is formed adjacent to the foot insertion opening in forward of the foot insertion opening.

17. The upper according to claim 13, wherein the second region is formed adjacent to the foot insertion opening in forward of the foot insertion opening.

18. The upper according to claim 14, wherein the second region is formed adjacent to the foot insertion opening in forward of the foot insertion opening.

19. The upper according to claim 15, wherein the second region is formed adjacent to the foot insertion opening in forward of the foot insertion opening.

20. A shoe comprising:

the upper according to claim 11; and a sole located below the upper.

* * * * *